US005152103A

United States Patent [19]

Tucker et al.

[11] Patent Number: 5,152,103

[45] Date of Patent: Oct. 6, 1992

[54] AUTOMATIC WINDOW SASH AND LOCK OPERATOR

[75] Inventors: Daniel G. Tucker, Waseca; Gregory J. Vetter, Owatonna, both of Minn.

[73] Assignee: Truth Division of SPX Corporation, Owatonna, Minn.

[21] Appl. No.: 761,334

[22] Filed: Sep. 17, 1991

Related U.S. Application Data

[63] Continuation-in-part of Ser. No. 504,349, Apr. 4, 1990, Pat. No. 5,054,239.

[51] Int. Cl.[5] ..... E05F 11/02

[52] U.S. Cl. ..... 49/279; 49/341; 49/345

[58] Field of Search ..... 49/279, 281, 324, 339, 49/341, 345

[56] References Cited

U.S. PATENT DOCUMENTS

| | | | |
|---|---|---|---|
| 27,119 | 2/1860 | Fay et al. . | |
| 1,471,736 | 10/1923 | Johnson . | |
| 1,640,459 | 8/1927 | Lee . | |
| 1,724,011 | 8/1929 | Flagg . | |
| 1,748,662 | 2/1930 | Stewart . | |
| 2,022,020 | 11/1935 | Westrope . | |
| 2,036,151 | 3/1936 | Lang . | |
| 2,114,645 | 4/1938 | Van Eenschoten . | |
| 2,136,812 | 11/1938 | Carnahan . | |
| 2,157,016 | 5/1939 | Reynaud . | |
| 2,256,613 | 9/1941 | Forman et al. . | |
| 2,366,613 | 1/1945 | Hagstrom . | |
| 2,449,761 | 9/1948 | Bemis . | |
| 2,538,980 | 1/1951 | Payne, Jr. . | |
| 2,784,459 | 3/1957 | Anderberg et al. . | |
| 2,797,917 | 7/1957 | Lickteig, Jr. et al. | 49/341 |
| 2,905,464 | 9/1959 | Shaw, Sr. . | |
| 3,081,078 | 3/1963 | Lohr . | |
| 3,145,988 | 8/1964 | Colautti et al. . | |
| 3,154,302 | 10/1964 | Maruyama . | |
| 3,202,414 | 8/1965 | Simmons et al. . | |
| 3,257,755 | 6/1966 | Lewis . | |
| 3,274,732 | 9/1966 | Murakami . | |
| 3,541,874 | 11/1970 | Du Rocher . | |
| 3,653,154 | 4/1972 | Hayday . | |
| 4,064,651 | 12/1977 | Homs . | |
| 4,241,541 | 12/1980 | Van Klompenburg et al. . | |
| 4,253,276 | 3/1981 | Peterson et al. . | |
| 4,266,371 | 5/1981 | Erdman et al. . | |
| 4,305,228 | 12/1981 | Nelson . | |
| 4,333,269 | 6/1982 | Bascou . | |
| 4,392,330 | 7/1983 | Buhr . | |
| 4,497,135 | 2/1985 | Vetter . | |
| 4,571,776 | 2/1986 | Taylor . | |
| 4,617,758 | 10/1986 | Vetter . | |
| 4,679,352 | 7/1987 | Bates . | |
| 4,726,092 | 2/1988 | Tacheny et al. . | |
| 4,823,508 | 4/1989 | Allen . | |
| 4,840,075 | 6/1989 | Tucker . | |
| 4,845,830 | 7/1989 | Nolte et al. . | |
| 4,860,493 | 8/1989 | Lense . | |
| 4,937,976 | 7/1990 | Tucker et al. . | |
| 5,050,345 | 9/1991 | Nakanishi | 49/279 |

FOREIGN PATENT DOCUMENTS

| | | | |
|---|---|---|---|
| 0323241 | 5/1989 | European Pat. Off. . | |
| 653755 | 12/1937 | Fed. Rep. of Germany . | |
| 1176021 | 8/1964 | Fed. Rep. of Germany . | |
| 2601342 | 1/1977 | Fed. Rep. of Germany . | |
| 43872 | 3/1960 | Poland . | |
| 481936 | 3/1938 | United Kingdom | 49/341 |

*Primary Examiner*—Renee S. Luebke
*Assistant Examiner*—Michael J. Milano
*Attorney, Agent, or Firm*—Wood, Phillips, VanSanten, Hoffman & Ertel

[57] ABSTRACT

A window operator and lock structure for controlling a window sash supported by a hinge for pivotal motion relative to a window frame, including a base mounted to the frame and supporting a drivable sun gear, and a planet gear engaging the sun gear and supported on the base for pivoting about the sun gear axis. One linkage is secured to the planet gear axis and the window sash to control motion of the sash. A locking structure secures the sash to the frame, which structure is operated by a gear arm fixedly secured to the planet gear and a cam link between the gear arm and the locking structure. Selective operation of the locking structure is effectuated by biasing the cam link against a fixed pin which engages a slot in the cam link to secure the cam link against operating the locking structure, and a trip on the sash which engages the cam link when the sash is closed against the frame to disengage the cam link from the pin.

11 Claims, 6 Drawing Sheets

AUTOMATIC WINDOW SASH AND LOCK OPERATOR

RELATED APPLICATION

This application is a continuation-in-part application to Ser. No. 504,349, filed Apr. 4, 1990, and now U.S. Pat. No. 5,054,239.

BACKGROUND OF THE INVENTION

1. Technical Field

The present invention is directed toward mechanical window operators, and more particularly toward operators for controlling movement and locking of casement or awning type windows.

2. Background Art

Casement and awning type windows are well known in the art in which a window sash pivots about one of its sides for opening and closing relative to a window frame on which it is supported. Many different types of window (and other closure) operators which are well known in the art for accomplishing this operation.

Of course, it is also usually desirable to also provide a positive mechanical locking connection between the sash and the frame to provide security against the sash being forced open by an intruder trying to gain entry. Unfortunately, with many window operators, the lock structure is completely separate from the operator, with the result sometimes being that the person manipulating the operator to close the window inadvertently fails to also positively lock the window.

Accordingly, some operators have been constructed so that manipulation of the operator structure will automatically sequentially operate the locking structure as well.

Examples of such operators are shown, for example, in Vetter U.S. Pat. No. 4,497,135, Payne U.S. Pat. No. 2,538,980, and Flagg U.S. Pat. No. 1,724,011.

For example, Flagg U.S. Pat. No. 1,724,011 uses a rack with a slot and pin arrangement to selectively operate either the window sash or the locking structure.

Vetter U.S. Pat. No. 4,497,135 discloses an automatic operator and locking mechanism in which separate gear drives on a corner of the sash are provided connecting an electric drive motor to the sash operator and lock mechanism, respectively, with a sash operated trigger restraining the lock mechanism against operation when the sash is open.

Tucker et al. U.S. Pat. No. 4,937,976 discloses an operator structure in which a handle is rotated to control movement of a sash, with the handle also being pivotable between active and inactive positions where such separate pivoting operates a locking mechanism for the window.

Ideally, a window operator should be simple to use, not only opening and closing the window, but also reliably ensuring that the window unlocks and locks as it is properly opened and closed. Further, such operators should, ideally, be readily usable in any number of different configurations to provide whatever type of window operation is desirable.

The present invention is directed toward providing such operating characteristics.

SUMMARY OF THE INVENTION

In one aspect of the present invention, a window operator and lock structure is provided for controlling a window sash supported by a hinge for pivotal motion relative to a window frame. The structure includes a base mounted to the frame and supporting a drivable sun gear, and a planet gear engaging the sun gear and supported on the base for pivoting about the sun gear axis. One linkage is secured to the planet gear axis and the window sash to control motion of the sash. A locking structure is also provided for securing the sash to the frame, which structure is operated by a gear arm fixedly secured to the planet gear and a cam link between the gear arm and the locking structure. Selective operation of the locking structure is effectuated by biasing the cam link against a fixed pin which engages a slot in the cam link to secure the cam link against operating the locking structure, and a trip on the sash engages the cam link to disengage it from the pin when the sash is closed against the frame.

It is an object of the present invention to provide an operator which can be inexpensively manufactured and installed.

It is a further object of the present invention to provide an automatic window operator and locking mechanism which may be conventionally mounted centrally on the frame for easy access for manual operation.

It is another object of the present invention to provide an operator which can be easily operated and at the same time provide reliable and foolproof locking.

It is still another object of the present invention to provide an automatic window operator and locking mechanism which has an aesthetically pleasing appearance when installed.

DESCRIPTION OF THE PREFERRED EMBODIMENT

Figure 1:
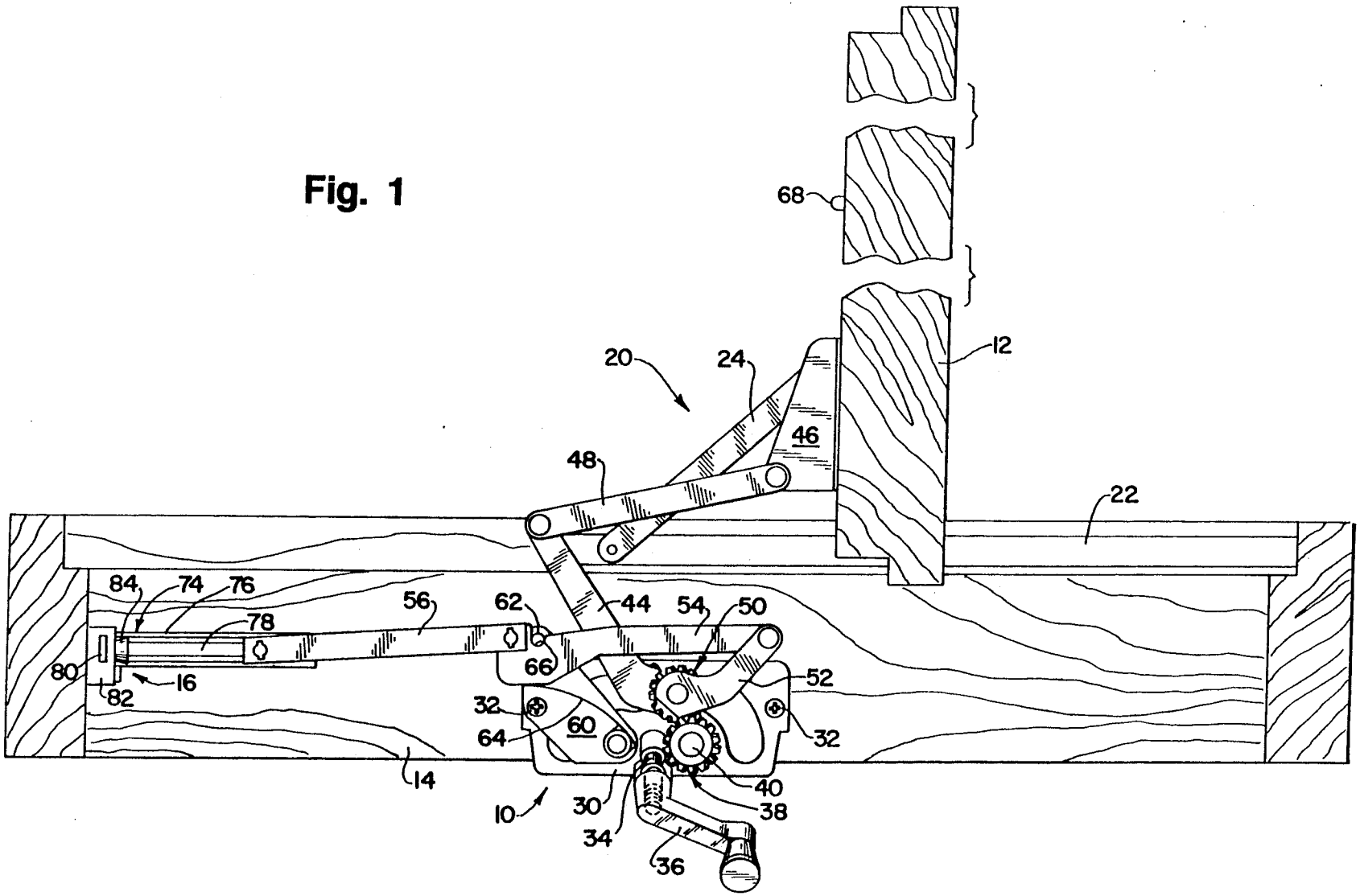
FIG. 1 is a plan view of the operator of the present invention showing the window sash in the open position.

FIG. 1 illustrates the operator 10 of the present invention, which operator 10 both controls pivoting of a window sash 12 relative to a window frame 14, and controls operation of a mechanism 16 for locking the sash 12 to the frame 14.

The sash 12 is supported on the frame 14 by a suitable hinge structure 20, such as the casement hinge shown. Specifically, the hinge structure 20 includes a track 22 suitably secured to the frame 14, which track 22 guides a slidable shoe pivotally connected to a support arm attached to the bottom of the sash 12 (the shoe and support arm are hidden beneath the sash 12, and thus not seen in the figures). A hinge link 24 is pivotally secured at one end to the track 22 and at the other end to the support arm. Accordingly, the window operates to provide a "washability" configuration when the window is opened (washable in the sense that a person can readily reach both sides of the window for washing when desired).

As will be apparent to a person of ordinary skill who has obtained an understanding of the present invention, the above described hinge structure 20 is merely an example of one type of hinge structure which could be used with an operator embodying the principals of the present invention.

Referring now to the operator 10, a base 30 is suitably secured to the frame 14, as by the screws 32 shown. The base 30 may be centrally located on the bottom side of the frame 14 as is preferable, as this is not only common for casement window operators but it also ensures that a person turning the operator 10 will not be restricted (or scrape their knuckles) by the sides of the frame 10.

Although not shown, this operator 10 may also be provided with a suitable cover to provide an aesthetically pleasing appearance. Further, as will become apparent, the components of the operator 10 require minimal space throughout the range of motion during operation, and therefore covers such as heretofore used by window operator manufacturers can typically be used with this operator. This is an important factor to those manufacturers which have important trademark and trade dress rights in their covers (for example, where a manufacturer uses a common cover design with different operators and the cover design is recognized in the market as an indication of the source of the operators).

Suitably supported on the base 30 is a worm drive 34 to which a rotatable handle 36 is suitably mounted. A sun gear 38 is rotatably supported on the base 30 about a suitable pin 40 defining a sun gear axis. The sun gear 38 meshes with the worm drive 34 so that clockwise rotation of the handle 36 (for opening the sash 12) causes the sun gear 38 to rotate counterclockwise.

A pull link 44 is suitably secured relative to the pin 40 for pivoting about the same axis as the sun gear 38. A bracket 46 is secured to the inside of the window sash 12 and is connected to the pull link 44 by a drag link 48 to operably connect the operator 10 to the sash 12.

The pull link 44 also pivotably supports a planet gear 50 which meshes with the sun gear 38, and a gear arm 52 is suitably secured to the planet gear 46 for pivoting therewith. A cam link 54 connects the gear arm 52 to an operator tie bar 56.

A base plate 60 is suitably secured to the base 30, and supports a pin 62. A leaf spring 64 is also suitably supported on the base plate 60 and engages the cam link 54 to bias the cam link 54 against the pin 62.

The cam link 54 also includes a recess or notch 66 which engages the pin 62 when the sash 12 is open as is described hereafter. Further, a spacer or trigger 68 is provided on the operator side of the window sash 12 to ensure that a minimum spacing between the cam link and the sash is maintained when the sash is closed against the frame, as is also described hereafter.

Figure 6:
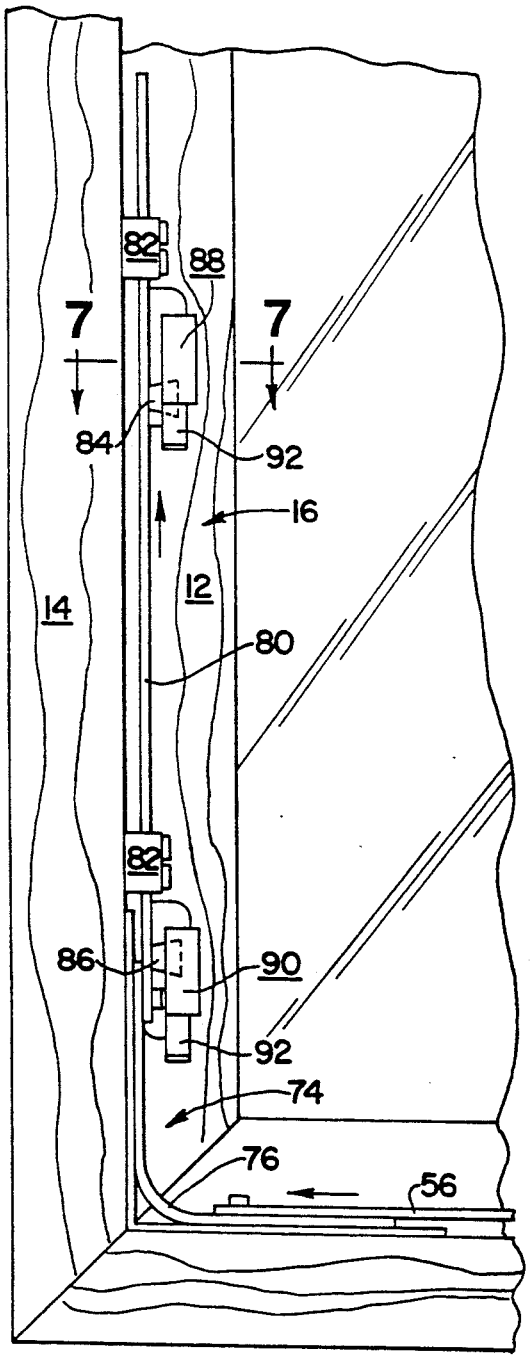
FIG. 6 corresponds to FIG. 5 in which the sash is closed and locked, and shows a broken partial view of the sash locked to the window frame.
Figure 7:
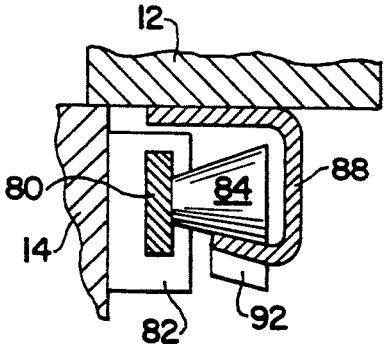
FIG. 7 is a cross-sectional view taken along line 7—7 of FIG. 6.

The locking mechanism 16 controlled by the operator is best illustrated in FIGS. 6 and 7.

Specifically, the locking mechanism 16 includes a suitable around-the-corner (ATC) mechanism 74, such as a 90° corner guide track 76 for a suitable (non-compressible) strap 78 (see FIG. 1) secured on one end to the operator tie bar 56 and on the other end to a lock tie bar 80 supported for vertical motion by suitable lock tie bar guides 82 fixed to the frame 14. The ATC mechanism 74 thus translates horizontal motion of the operator tie bar 56 into vertical motion of the lock tie bar 80.

The lock tie bar 80 supports a pair of rollers 84, 86, which are associated with a pair of keepers 88, 90 suitably secured to the side of the sash 12. The keepers 88, 90 each include a ramped portion 92, and also are spaced from one another slightly less than the rollers 84, 86 are spaced for sequential locking as described in greater detail hereafter.

Functioning of the operator 10 and locking mechanism 16 is as follows.

Figure 2:
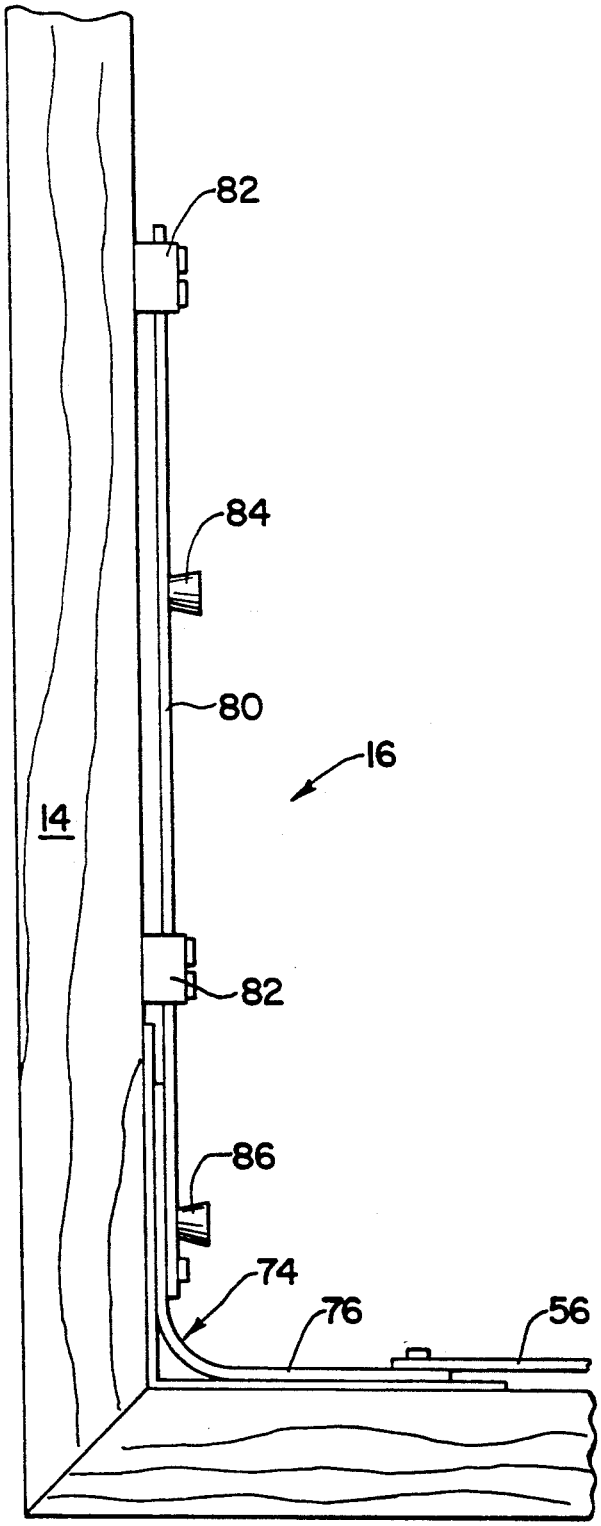
FIG. 2 corresponds to FIG. 1 in which the sash is open, and shows a broken partial view of the window frame and locking mechanism.

Closing of an open window (from the position illustrated in FIGS. 1 and 2) is accomplished by rotating the handle 36 counterclockwise, which through the worm drive 34 causes the sun gear 38 to rotate clockwise. Since the cam link 54 is secured against axial motion by the engagement of its recess 66 with the pin 62, clockwise rotation of the sun gear 38 causes the planet gear 50 and connected pull link 44 to also rotate clockwise about the sun gear pin 40. As a result of this motion, the pull link 44 and drag link 48 cooperate to push the sash bracket 46 toward a window closed position as shown in FIG. 3.

Figure 3:
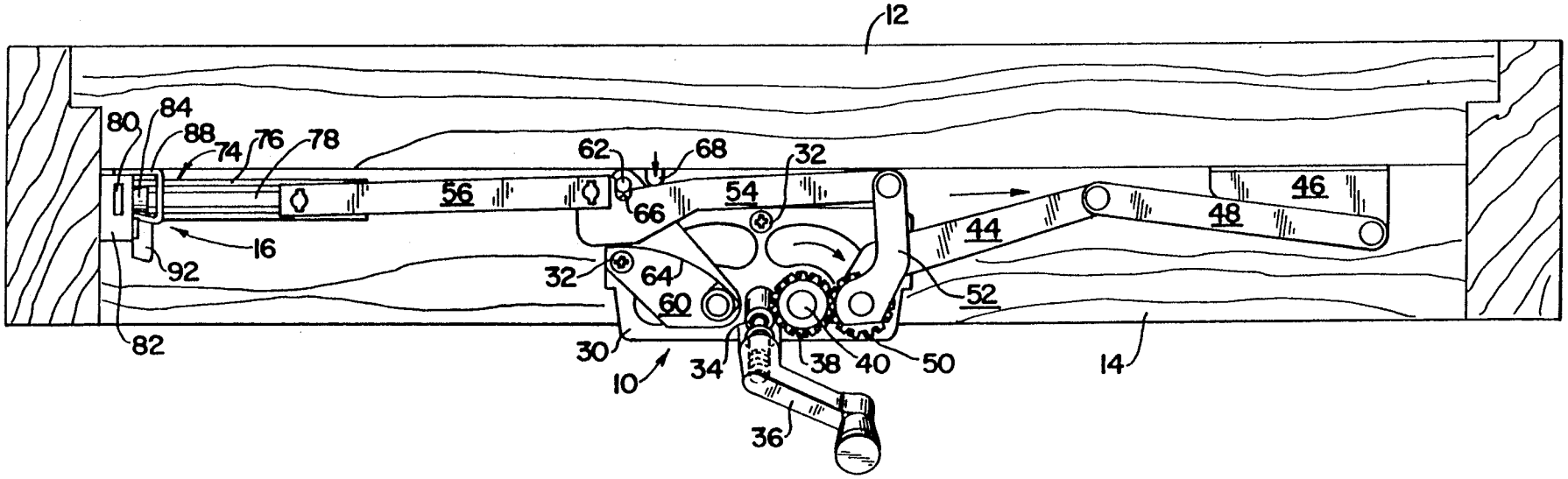
FIG. 3 is a plan view similar to FIG. 1, but showing the window sash closed and not yet locked to the frame.

As the window shuts with the sash 12 against the frame 14 as in FIG. 3, the trigger 68 engages the cam link 54, pivoting the link 54 away from the sash 12 so that the cam link notch 66 disengages from the pin 62. When the pin 62 is so disengaged, the cam link 54 is no longer restrained and thus continued pivoting of the handle 36 to drive the sun gear 38 clockwise causes the planet gear 50 and connected gear arm 52 to pivot counterclockwise. Such pivoting of the gear arm 52 causes the connected cam link 54 and operator tie bar 56 to move to the left (from the FIG. 3 position to the FIG. 5 position). Leftward movement of the operator tie bar 56 operates through the ATC mechanism 74 to cause the lock tie bar 80 to move up for locking (from the FIG. 4 position to the FIG. 6 position).

Figure 4:
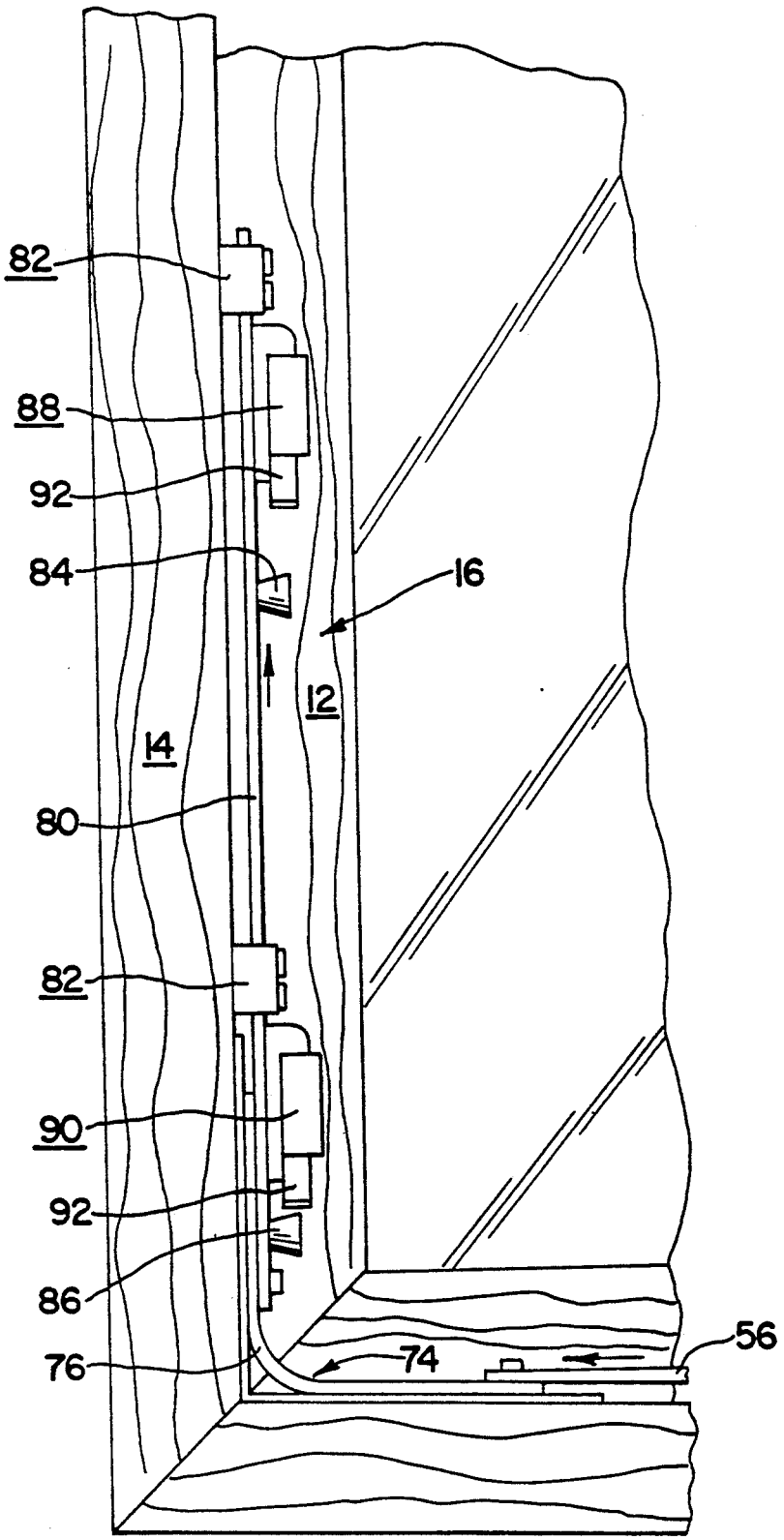
FIG. 4 corresponds to FIG. 3 in which the sash is closed, and shows a broken partial view of the sash closed against, the window frame but not yet locked thereto.
Figure 5:
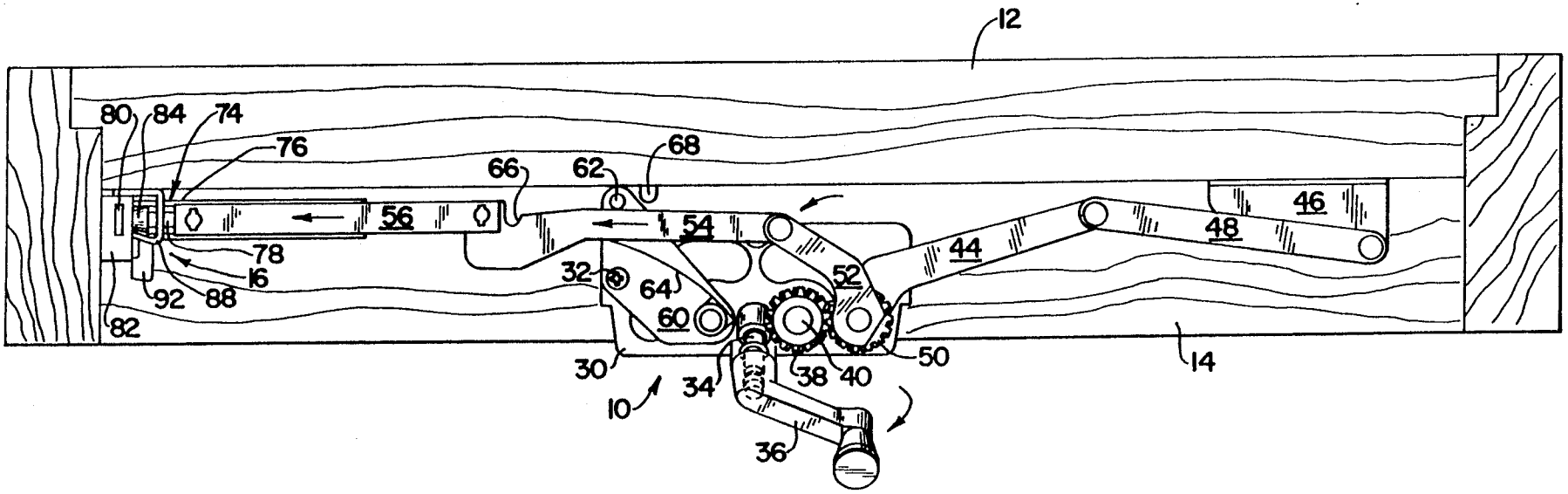
FIG. 5 is a plan view similar to FIG. 3 in which the sash is closed, but showing the window sash closed and locked to the frame.

Sequential operation of the locking mechanism 16 can be seen in FIGS. 4, 6 and 7. Specifically, when the sash 12 is first closed against the frame 14 as in FIG. 4, the rollers 84, 86 are vertically spaced clear of the keepers 88, 90 to allow clearance. When the operator tie bar 80 is then moved up, the lower roller 86 first engages the ramped portion 92 of the keeper 90 to initiate tight closing of the sash 12 against the frame 14 (preferably including a weather strip, not shown). As the lower roller 86 is moved up the ramped portion 92 and keeper 90, the upper roller 84 is sequentially caused to engage first the ramped portion 92 of the upper keeper 88 and then the upper keeper 88 itself. At the upper range of motion of the lock tie bar 80, both rollers 84, 86 engage the keepers 88, 90 to securely lock the sash 12 to the frame 14 as best illustrated in FIGS. 6 and 7.

Opening of a locked window is thus easily accomplished by simply pivoting the handle 36 in the reverse, clockwise direction. Specifically, such pivoting of the handle 36 causes the sun gear 38 to rotate counterclockwise and thereby exert a clockwise force on the planet gear 50. Since the locking mechanism 16 is restraining the sash 12 from opening, this force on the planet gear 50 causes the planet gear and connected gear arm 52 to pivot clockwise and thereby move the cam link 54 and operator tie bar 56 to the right. This thereby acts through the ATC mechanism 74 to pull the lock tie bar 80 down and clear the rollers 84, 86 from the keepers 88, 90.

At this point, with the locking mechanism 16 unlocked, the operator 10 is in the FIG. 3 position, with the flat surface adjacent the cam link notch 66 engaging the pin 62 to prevent further movement of the cam link 54 to the right. As a result, continued rotation of the handle causes the planet gear 50 and connected pull link to pivot counterclockwise about the sun gear 38, thereby causing the pull link 44 and associated drag link 48 to pull on the bracket 46 and open the sash 12 (such as shown in FIG. 1).

The operator 10 thus functions ideally by simply requiring a person to turn a handle which automatically operates to control movement of the sash 12 and the locking mechanism 16. Since different operations are not required of the person to control the different movements, there is no risk that the person will inadvertently fail to lock the sash 12. Similarly, there is no danger that the frame 14, sash 12, or operator might be damaged as a result of a person forcing the operator to open a window which is, unknown to the person, locked against opening.

Further, this ideal operation is accomplished by a structure which can be inexpensively manufactured and installed, with installation of the operator being centrally on the frame for easy access for manual operation. In fact, the space requirements of the operator 10 are similar to those of other window operators on the market, so that a wide variety of aesthetically pleasing covers may be used with this operator.

Still other aspects, objects, and advantages of the present invention can be obtained from a study of the specification, the drawings, and the appended claims.

We claim:

1. A window operator and lock structure for controlling a window sash supported by a hinge for pivotal motion relative to a window frame, said structure comprising:

a drive gear rotatable about a drive axis;

a planet gear engaging said drive gear, said planet gear being rotatable about its axis and pivotable about the drive axis;

a hinge linkage pivotable about the drive axis with the planet gear and fixed to the window sash to effectuate pivotal motion of the sash relative to the frame when said planet gear and linkage are pivoted about the drive axis;

means on said frame for selectively locking said sash to said frame; and means for selectively controlling said locking means in response to said drive gear when said sash is closed against said frame, including a member fixed relative to the frame, a lock linkage between said locking means and said planet gear whereby rotation of said planet gear about its axis moves said linkage to selectively operate said locking means, said lock linkage including a portion engageable with said fixed member to secure said lock linkage against operating said locking means, means for biasing said lock linkage toward engagement of said lock linkage portion with said fixed member, and means for disengaging said lock linkage portion from said fixed member when said sash is closed against said frame.

2. The window operator and lock structure of claim 1, wherein said disengaging means comprises a trigger providing a minimum spacing between lock linkage and said sash when said sash is closed against said frame, said minimum spacing being sufficient to position said lock linkage portion out of engagement with said fixed member.

3. The window operator and lock structure of claim 2, wherein said trigger comprises a spacer mounted on said sash.

4. The window operator and lock structure of claim 2, wherein said fixed member is disposed between the lock linkage and the window sash.

5. The window operator and lock structure of claim 1, wherein said biasing means comprises a leaf spring fixed relative to said sash and engaging said lock linkage.

6. The window operator and lock structure of claim 1, further comprising a rotatable handle for rotating a worm gear engaging said drive gear.

7. The window operator and lock structure of claim 1, wherein said fixed member comprises a pin, and said lock linkage portion comprises a recess in said lock linkage for receiving said pin.

8. The window operator and lock structure of claim 1, wherein said lock linkage comprises:

a gear arm fixedly secured to the planet gear for rotation and pivoting therewith;

a cam link pivotally secured at one end to the gear arm and operably connected to said locking means at the other end, said cam link moving laterally relative to said frame in response to rotation of said planet gear and gear arm to selectively operate said locking means;

wherein said lock linkage portion is on said cam link and restrains said cam link against lateral movement when engaging said fixed member 9. The window operator and lock structure of claim 8, wherein said fixed member comprises a pin, and said lock linkage portion comprises a recess in said lock linkage for receiving said pin.

10. The window operator and lock structure of claim 9, wherein said lateral movement of said cam link is substantially axial to said link, and said recess includes a surface substantially normal to the axial direction of the cam link to secure said cam link against axial movement operating said locking means.

11. A window operator and lock structure for controlling a window sash supported by a hinge for pivotal motion relative to a window frame, said structure comprising:

a base mounted to the frame and supporting a sun gear for rotation about a sun gear axis;

means for drivably rotating said sun gear;

a planet gear rotatable about a planet gear axis and engaging said sun gear, said planet gear further being supported on said base for pivoting about said sun gear axis;

a first linkage pivotally secured at one end to the planet gear axis and secured at the other end to the window sash for controlling pivotal motion of the sash relative to the frame;

axially reciprocable means on said frame for selectively locking said sash to said frame; and means for controlling said locking means, including a gear arm fixedly secured to the planet gear, a pin fixed relative to the frame, a cam link pivotally secured at one end to the gear arm and operably connected to said locking means at the other end, said cam link including a portion engageable with said pin to secure said controlling means against operating said locking means, means for biasing said cam link portion toward engagement with said pin when said sash is closed against said frame, and a trip on said sash engageable with said cam link to disengage said cam link portion from said pin when said sash is closed against said frame.

* * * * *